US005546359A

United States Patent [19]

Aarseth

[11] Patent Number: 5,546,359

[45] Date of Patent: Aug. 13, 1996

[54] METHOD AND TRANSMITTER/RECEIVER FOR TRANSFERRING SIGNALS THROUGH A MEDIUM IN PIPES AND HOSES

[75] Inventor: Finn Aarseth, Hvalstad, Norway

[73] Assignee: Aker Engineering AS, Norway

[21] Appl. No.: 404,316

[22] Filed: Mar. 15, 1995

[30] Foreign Application Priority Data

Mar. 16, 1994 [NO] Norway ..... 940952

[51] Int. Cl.[6] ..... H04B 11/00; G01V 1/40

[52] U.S. Cl. ..... 367/134; 367/83

[58] Field of Search ..... 367/134, 81, 82, 367/83, 84

[56] References Cited

U.S. PATENT DOCUMENTS

| | | | |
|---|---|---|---|
| 3,863,203 | 1/1975 | Patton et al. | 367/85 |
| 4,007,331 | 2/1977 | Flanagan | 367/134 |
| 4,027,282 | 5/1977 | Jeter | 367/85 |
| 4,045,767 | 8/1977 | Nishihara et al. | 367/134 |
| 4,078,620 | 3/1978 | Westlake et al. | 367/83 |
| 4,797,668 | 1/1989 | Zimmer | 367/81 |
| 4,914,637 | 4/1990 | Goodsman | 367/83 |
| 5,055,837 | 10/1991 | Abdallah et al. | 367/83 |
| 5,128,901 | 7/1992 | Drumheller | 367/82 |
| 5,148,408 | 9/1992 | Matthews | 367/82 |

FOREIGN PATENT DOCUMENTS

| | | |
|---|---|---|
| 0309030 | 3/1989 | European Pat. Off. . |
| 0617196 | 9/1994 | European Pat. Off. . |
| 3511867 | 10/1985 | Germany . |
| 143292 | 9/1980 | Norway . |
| 158232 | 4/1988 | Norway . |
| 162687 | 10/1989 | Norway . |

*Primary Examiner*—Daniel T. Pihulic

*Attorney, Agent, or Firm*—Hedman, Gibson & Costigan, P.C.

[57] ABSTRACT

The present invention relates to a method and a transmitter/receiver for transferring signals through a medium in pipes or hoses, whereby at a transmitter side pressure pulses are generated of various frequencies or in various frequency ranges, and for the purpose of providing a technology which eliminates error sources, it is proposed according to the invention that the pressure pulses be generated at the transmitter side as an organised and defined bit pattern in order thereby to achieve one or two-way alphanumeric communication.

15 Claims, 8 Drawing Sheets

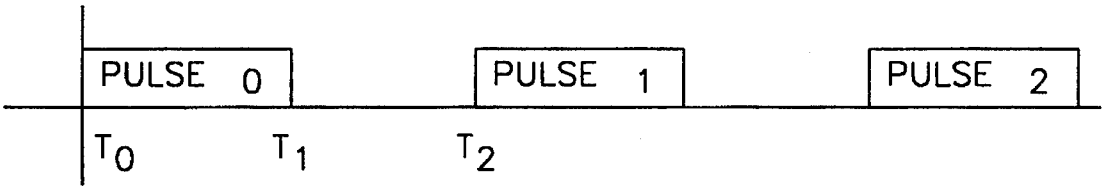

FREQUENCY PHASE MODEL WITH COMPLEX SIGNALS (SYNCHRONOUS COMMUNICATIONS)

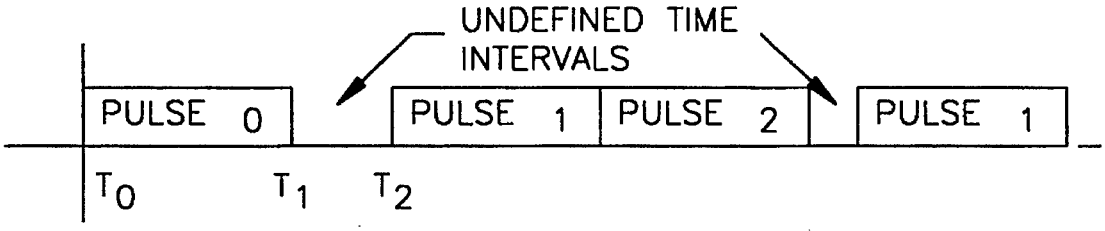

TIME FREQUENCY PHASE MODEL WITH COMPLEX SIGNALS (ASYNCHRONOUS COMMUNICATIONS)

n = NO. OF FREQUENCIES USED $f_1$ = FREQUENCY NO. 1

$T_0$ = START OF PULSE NO. 1

$T_1$ = END OF PULSE NO. 1

$$(1)\quad F(t) = \begin{cases} \sum_{0}^{n} \sin(f_1 \cdot 2 \cdot \pi \cdot t) & \text{FOR } T_0 < t < T_1 \\ (\ ) & \text{FOR } T_1 < t < T_2 \end{cases}$$

COMMUNICATIONS PROTOCOL FOR FREQUENCY PHASE MODULATED COMPLEX SIGNALS

*FIG. 5*

METHOD AND TRANSMITTER/RECEIVER FOR TRANSFERRING SIGNALS THROUGH A MEDIUM IN PIPES AND HOSES

THE SCOPE OF THE INVENTION

The present invention relates to a method for transferring signals through a medium in pipes, hoses and drilling holes, pressure impulses being generated at a transmitter side of various frequencies or in various frequency ranges.

The present invention also relates to a transmitter and a receiver for transmitting as stated.

PRIOR ART

Pressurized pipe systems generally have maneuvering organs for valves as well as other types of instruments, inter alia for the recording of process variables which are inaccessible for operation by crew members. These functions are usually remotely controlled through pneumatic, hydraulic, electrical, telemetric and similar systems and devices.

Frequently a combination of the above mentioned systems is used, in which the pneumatic/hydraulic power supply is controlled by electrically operated opening devices, with recording and feed-back of process variables through the same or through separate electrical cables.

A typical example is remote control of subsea devices, connecting, via an umbilical with hydraulic tubes and electrical cables, the device with a vessel/platform.

A version of this system is provided when electrical control and communication are replaced by cordless ether —telemetric or hydroacoustic communication of alphahumeric data. The device will then need to be capable of including its own power supply in the form of a battery or such like, to drive the instruments.

Such systems utilize the ambient environment as the medium of transmission and are thus vulnerable to external disturbances.

When they are used in controlling critical pneumatic and hydraulic functions, the requirements as to reliability, security and safety are therefore high. This consequently makes the systems very complicated and expensive.

With subsea devices, furthermore, electrical conductors as well as ether and hydroacoustic telemetry systems have definite practical and physical limitations in the reliability obtainable and their possible range for safe and secure communication.

A common feature of the systems mentioned is that by and large they represent an outside appurtenant auxiliary system, the purpose of which most often is to remotely control pneumatic and hydraulic primary functions.

In terms of safety and security, both the auxiliary and the primary system are arranged for "Fail safe", i.e. upon occurrence of the most critical fatal system error, the system shall fail in security with the least possible dramatic outward consequences.

In practice this means an unwanted close-down of one or several processes, which frequently represents large financial losses and increased danger to the outside environment.

The most prominent error in the said auxiliary system is breakdowns in the communications line. Electrical cords here are sensitive to mechanical damage, insulation and couplings, in particular when these are submerged. Ether and hydroacoustic telemetry systems are easily influenced by movable objects in the communications line as well as by changes in the environment.

Fatal errors in pneumatic and hydraulic primary systems are breakage and loss of power medium, whereupon the maneuvering organs automatically via steel springs govern a controlled close-down of the process.

Errors in the auxiliary systems are often arranged so that the pressurized driving medium in the primary systems is drained and causes a close-down of the process.

It is also known that all remotely controlled pneumatic and hydraulic systems, except for directly controlled ones, introduce a further external auxiliary system running in parallel with the primary system. Such external systems thus by their physical existence, represent a quantified source of error.

In connection with the production of oil and gas and the injection of water in the well system, there are often used one or more shut-off valves in a tree-system (well-head christmas tree) per drilling hole.

The wellhead tree is at the upstream side anchored to an underground cemented pipe in the drilling hole leading down to the oil and gas reservoir, and represents together with a safety valve (SS CV) located usually 200 m below ground surface, a security barrier between the over-pressure in the reservoir and the external environment.

Each point of the geometric lining of one or more reservoirs to be recovered, will thus be connected to a plurality of parallel sub-surface pipes.

Each valve tree and sub-surface safety valve are operated from the surface and are under normal conditions controlled for opening, choking and closing.

Usually, only a small number of drilling holes in a reservoir are used at a time, whereas the remaining production holes are shut down in the event of new accumulation of oil and gas.

It is specific that the absence of adequate remote control technique for sub-surface located valves, will prevent reservoir complementation wherein a drilling hole through branch drilling and valves are used for reaching various points of the reservoir or an adjacent reservoir.

SUMMARY OF THE INVENTION

The object of the present invention is to provide a system which constitutes an improvement relative to known systems, especially with regard to eliminating the error sources mentioned.

This is achieved in a method of the kind stated in the preamble, which according to the invention is characterized in that the pressure pulses are generated at the transmission side as an organized and defined bit-pattern in order thereby to obtain one- or two-way alphanumeric communication.

With the invention concerned, therefore, it is possible to utilize the liquid and the gas inside the pipe of a primary system in transmitting alphanumeric communication for tasks of a technical instrumentation nature in a controlled, defined, safe and secure environment.

Alternatively, pipe connections for such communication may be dedicated to such transmission of signals, may have other process related main purposes, or constitute combined power medium and signal supply.

The present invention thus relates to a system for cordless transmission of alphanumeric data, where signals are transferred through pipes or hoses filled with gas and liquid, as defined encoded pressure pulses.

The invention relates to a method for defining and encoding pressure pulses which increase the accessible bandwidth and digital transmission rate.

Against this background, corresponding descriptions emerge for the invention according to the attached claims, namely Signal Pipe Bus, Process Pipe Bus, Power Pipe Bus, and Well Pipe Bus.

The concept "Bus" in this connection comprises the communication lines in a closed system of pipes/hoses with pertaining volume, wherein one or several transmitters and receivers exchange data according to an organized and defined pattern. Such communication may typically comprise messages for controlling, recording, and diagnosing equipment and processes.

It is known that various devices exist which use medium in pipelines to control and feed back process variables. Examples thereof are frequency governed valves, NO patent 158.232 and drilling equipment MWD patent U.S. Pat. No. 4,914,637.

Common to these is that they respectively respond to or generate exclusively discrete frequency modulated pressure pulses for a one-way communication line. They do not employ any kind of organized and defined bit-pattern for one- or two-way alphanumeric communication.

Frequency modulated pressure pulses transferred through media in pipes are subject to marked damping which is among other things due to signal frequency, the material, diameter and length of the pipe, as well as the properties of the medium.

Higher frequencies are always dampened more rapidly than low ones. In ordinarily dimensioned systems for pneumatics and hydraulics, the usable bandwidth will in practice lie in the range from 0 to 50 Hz.

At such low frequencies and narrow bandwidth, the possible scope, content and actuality for a relevant communication would be severely restricted.

According to the invention, however, the usable bandwidth for pipe systems with high damping may be extended by the use of complex signals. Here the accessible single frequencies are combined together in groups of two or several frequencies in a simultaneous transmission.

In this manner, the bandwidth which can be utilised will be multiplied as required and realise a formerly unknown potential of possible communication in most pipe dimensions.

Additional advantages and features of the invention will be described in greater detail below under reference to the attached drawings.

BRIEF DESCRIPTION OF THE FIGURES IN THE DRAWINGS

FIG. 5 shows algorithms for digital alphanumeric communication and the manner in which these, according to the present invention, will be transmitted through the medium in a pipe/hose.

DESCRIPTION OF THE EMBODIMENTS

Figure 1:
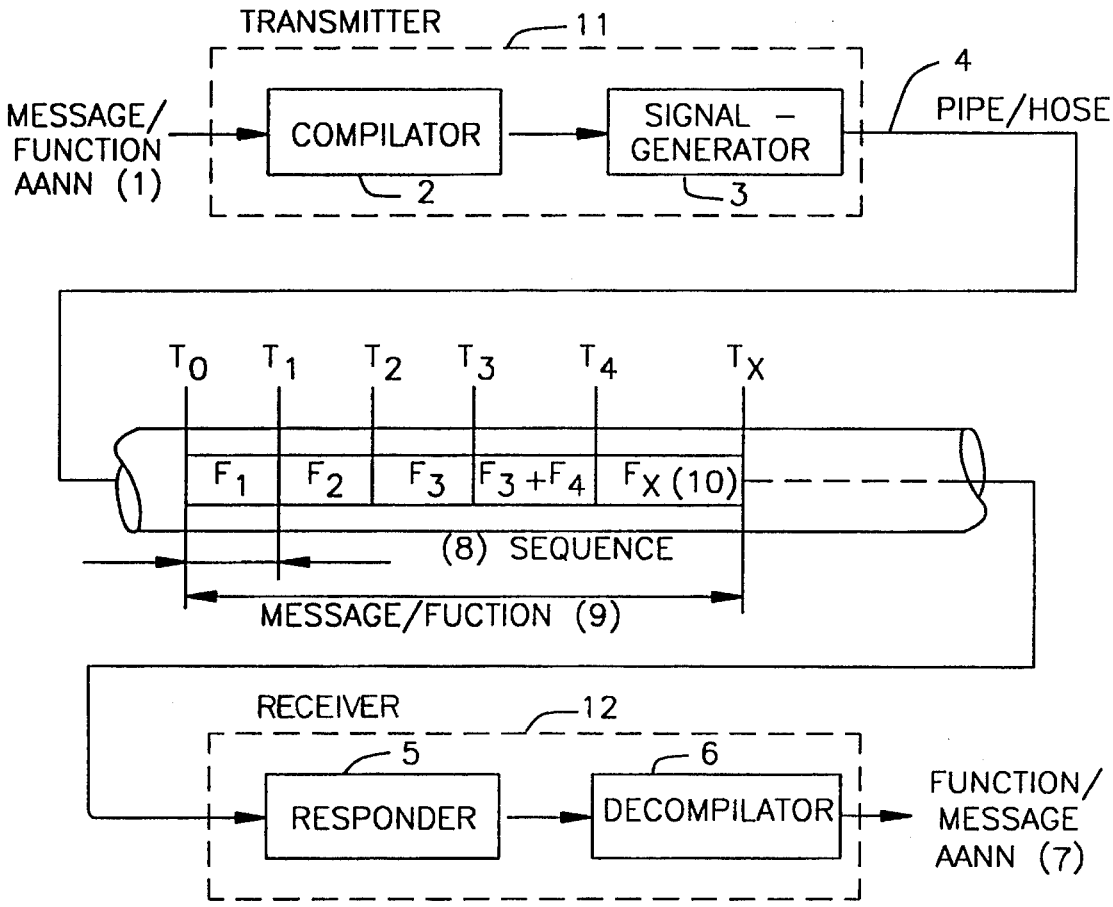
FIG. 1 shows an example of a simple communications system according to the present invention, in the form of a transmitter consisting of a compiler and a signal generator, a pipe or a hose whose medium transfers encoded signals, and a receiver consisting of a responder which reads the codes and allows these to be converted in a decompiler.

FIG. 1 shows a one-way communication system (simplex) which transmits and receives digital alphanumeric data.

A two-way system (semi duplex) is obtained when the transmitter and receiver are combined in one unit and placed at either end of the pipe/the hose.

Several transmitters/receivers 11, 12 may be positioned along a pipe/hose or in a pipe system with associated volume. A transmitter will then generally have a superior function of directing communication.

The message I is established in digital alphanumeric format which may contain letters and figures. The compilator 2 converts the said alphanumeric data into frequency codes and corresponding algorithms. They govern the signal generator 3 which produces volume flow changes and of corresponding pressure profile in the connected pipe/hose 4.

The pressure profiles or the amplitude of the signal may, depending on the damping and the amplifying properties of the pipe/hose system, vary from very low values to several tens of bars.

The variation in the signal amplitudes will center around the middle pressure of the pipe medium, and transfer at the speed of sound through the medium.

The message I will be capable of being read by a number, in principle unlimited, of responders 5, arranged at the receiving side 12, but will only be decompiled in a decompilator 6 as a whole message 7 at addressed receivers.

Figure 2:
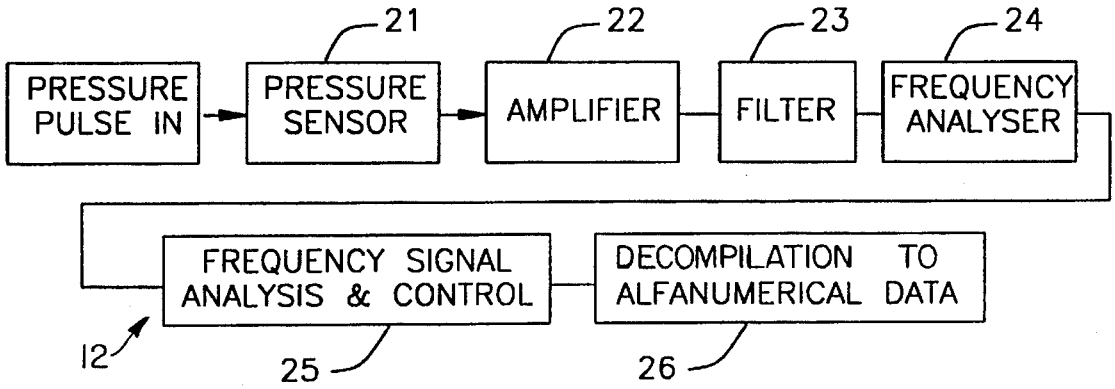
FIG. 2 shows a detailed functional diagram of a receiver where the variations in pressure are being detected, amplified, filtered and analyzed with regard to the presence of Fourier-series frequency elements as well as their dating in time, and, following inspection and checking for validity, the signals are converted into alphanumeric data.

Shown in FIG. 2 is the detailed function of a receiver 12. The pressure variations in the system will at any time be recorded by a pressure sensitive element 21 and be amplified up into an amplifier 22 for further processing of the signal. The frequency modulated signal transmission will usually have a predetermined frequency band and pressure amplitudes, allowing any other noise to be filtered off in its entirety in a filter 23. Thereafter, time sequenced frequency elements are identified in a frequency analyzer 24. Each receiver has one discrete and one common address (shared by several).

The first and the last sequence in all messages are addresses. The initial address opens the reception at the addresser's who receives all sequences until the final sequence which may be an address of another addressee. Sequences received will at once be made the subject of a signals analysis and checking in an inspection means 25 before the message is decompiled in a decompiler 26 into a uniform alphanumeric format.

Figure 3:
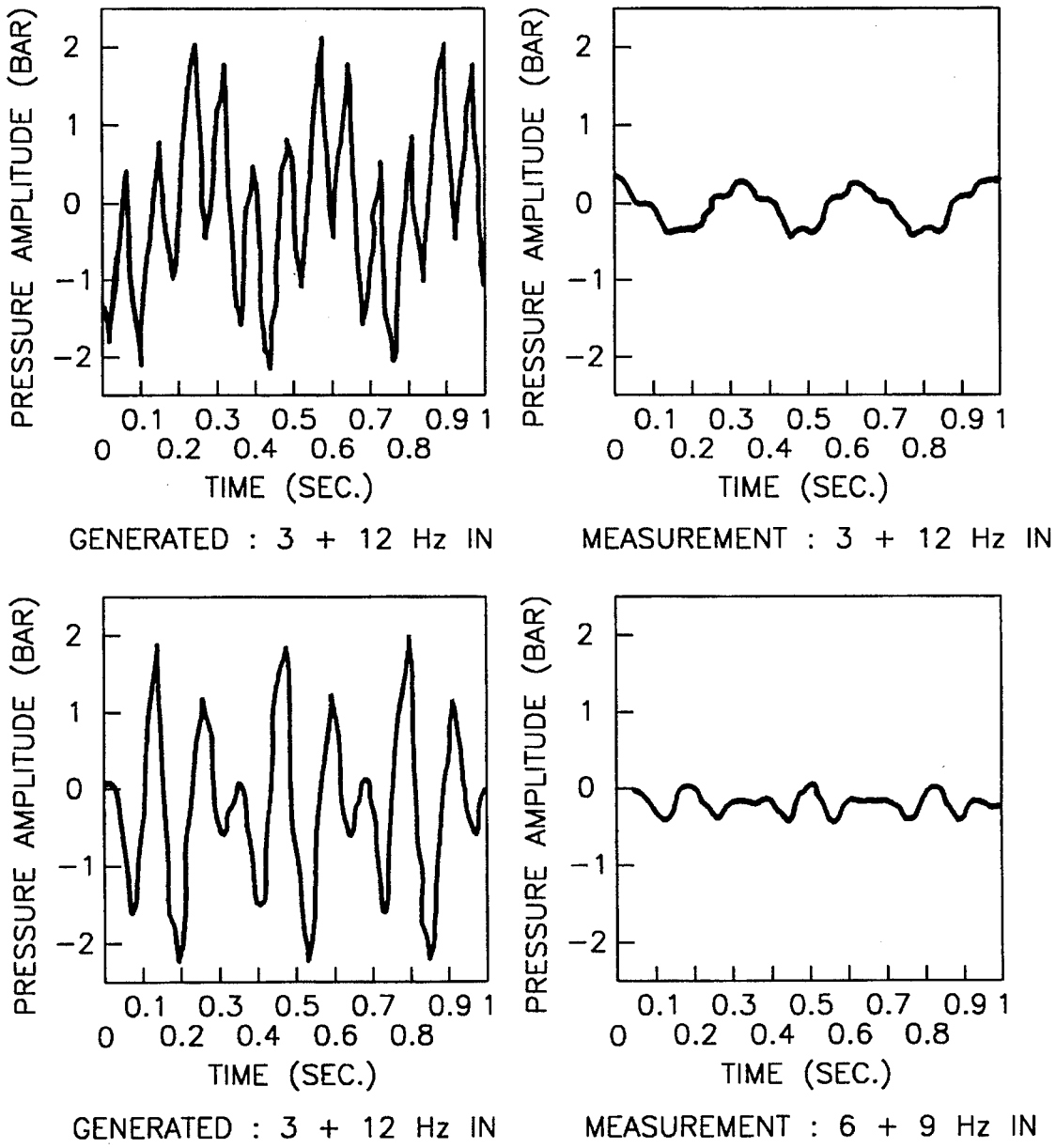
FIG. 3 shows the result of full-scale trials and analysis of sending, transmission and reception of complex frequency modulated signals.

From FIG. 3 it is evident how individual frequency modulated sinusoidal pressure signals may be put together to form a complex signal as an element in a Fourier-series. Furthermore, the result from a full-scale testing shows that substantially the same damping is achieved as if each element of the complex signal were to have been the subject of separate transmission.

This entails that complexly designed sinusoidal pressure signals are not distorted and may be decomposed for an intelligent utilisation of programmed information content.

Figure 4:
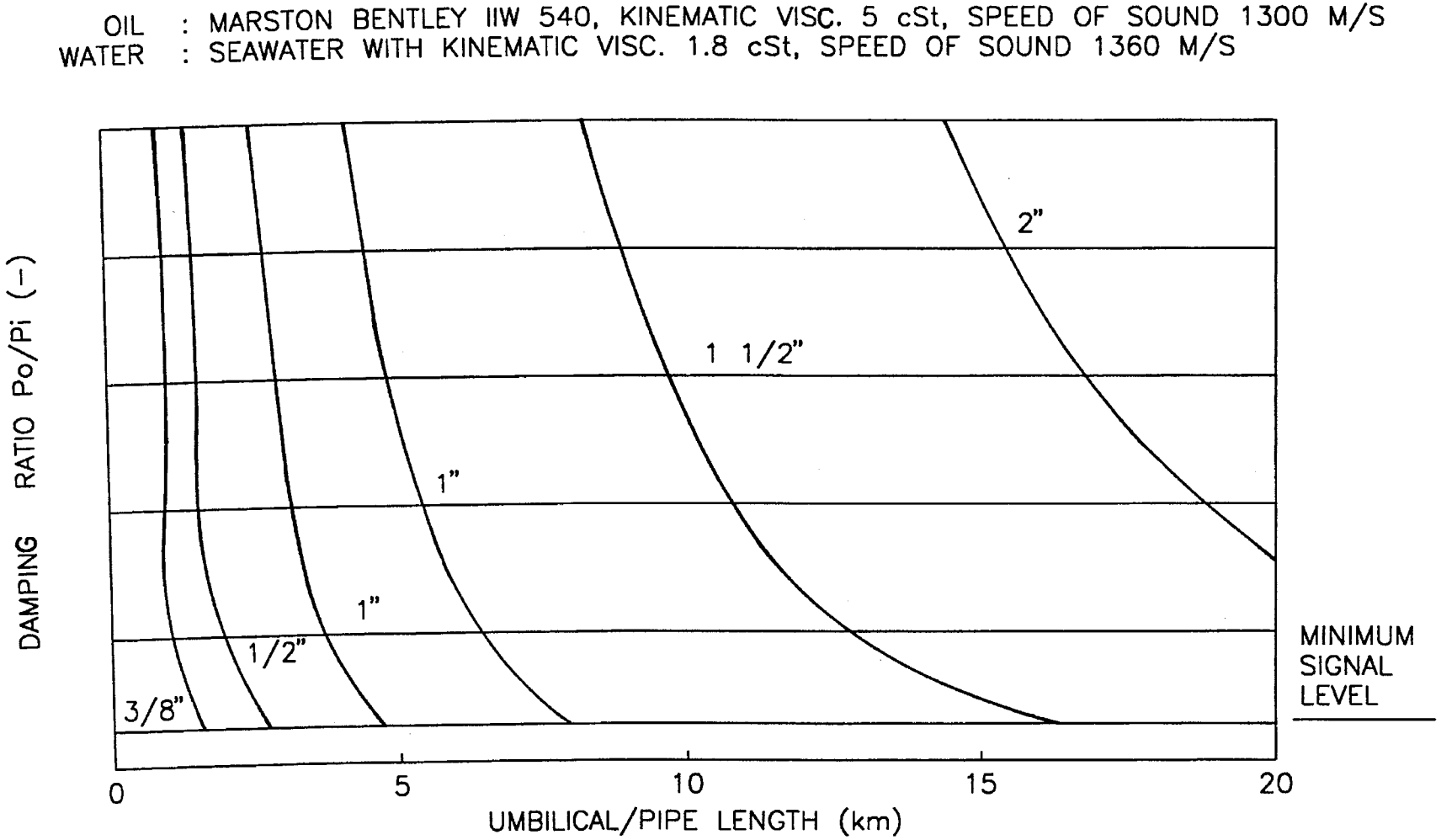
FIG. 4 shows typical damping of frequency modulated sinusoidal pressure signals in pipes and hoses.

It is shown in FIG. 4 that frequency modulated sinusoidal pressure signals are strongly amplified and dampened depending on the physical properties and nature of the system concerned.

Practical tests in existing pipe systems show that the resonance and pressure reflections of some pipe systems may block off a stable transmission of signals.

This is overcome by implementing relevantly dimensioned accumulators as required.

Shown in FIG. 5 is a preferred algorithm for frequency modulated pressure signals for alphanumeric communication in pipes/hoses.

A mere time modulation of signals similar to that of morse will at e.g. a bandwidth of 50 Hz give inappropriately cumbersome and slow communication.

Similarly, a frequency phase modulation (synchronous communication) with sequences of accessible frequencies within the same bandwidth will become very slow <1 bit per second. By introducing complex frequency modulated signals in a frequency phase model (synchronous communication) a transmission rate at e.g. 50 Hz could be expected to increase to about 10 bits per second.

In the above transmission concept is combined in a time phase frequency model, where complex signals are included, satisfactory communication up to about 20 bits per second may be expected at the same bandwidth.

Figure 6:
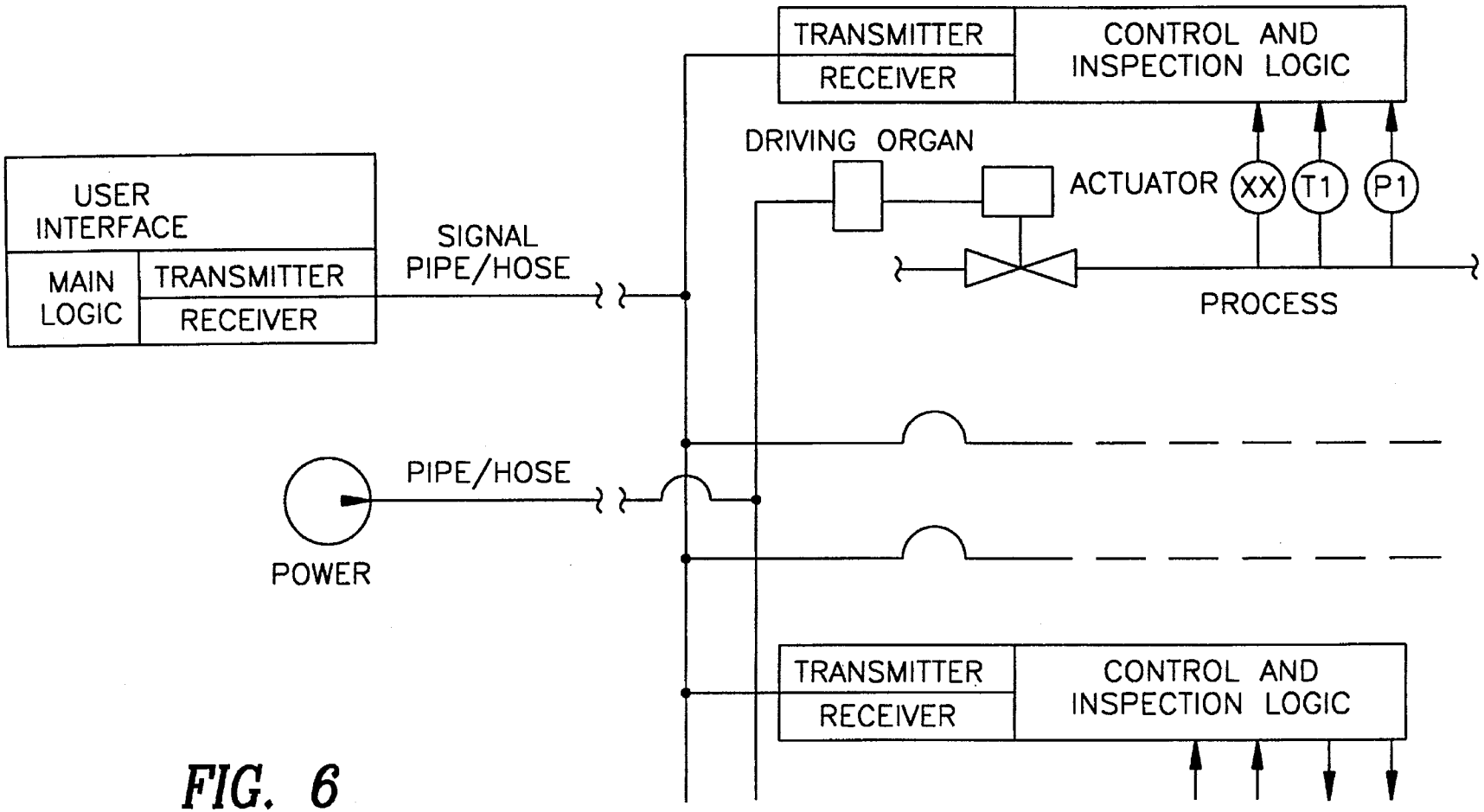
FIG. 6 shows a typical example of a Signal Pipe Bus.

In FIG. 6 is shown the topological design of a possible Signal Pipe Bus system where frequency modulated signals are transmitted in a dedicated liquid or gas filled pipe/hose.

The transmitters/receivers are here connected to digital governing and controlling logics for administration of local tasks in terms of technical instrumentation. Centrally placed main logic will normally direct and define priorities in the system's communication. The operative interface may be connected to manual operation and/or an overall controlling system.

Figure 7:
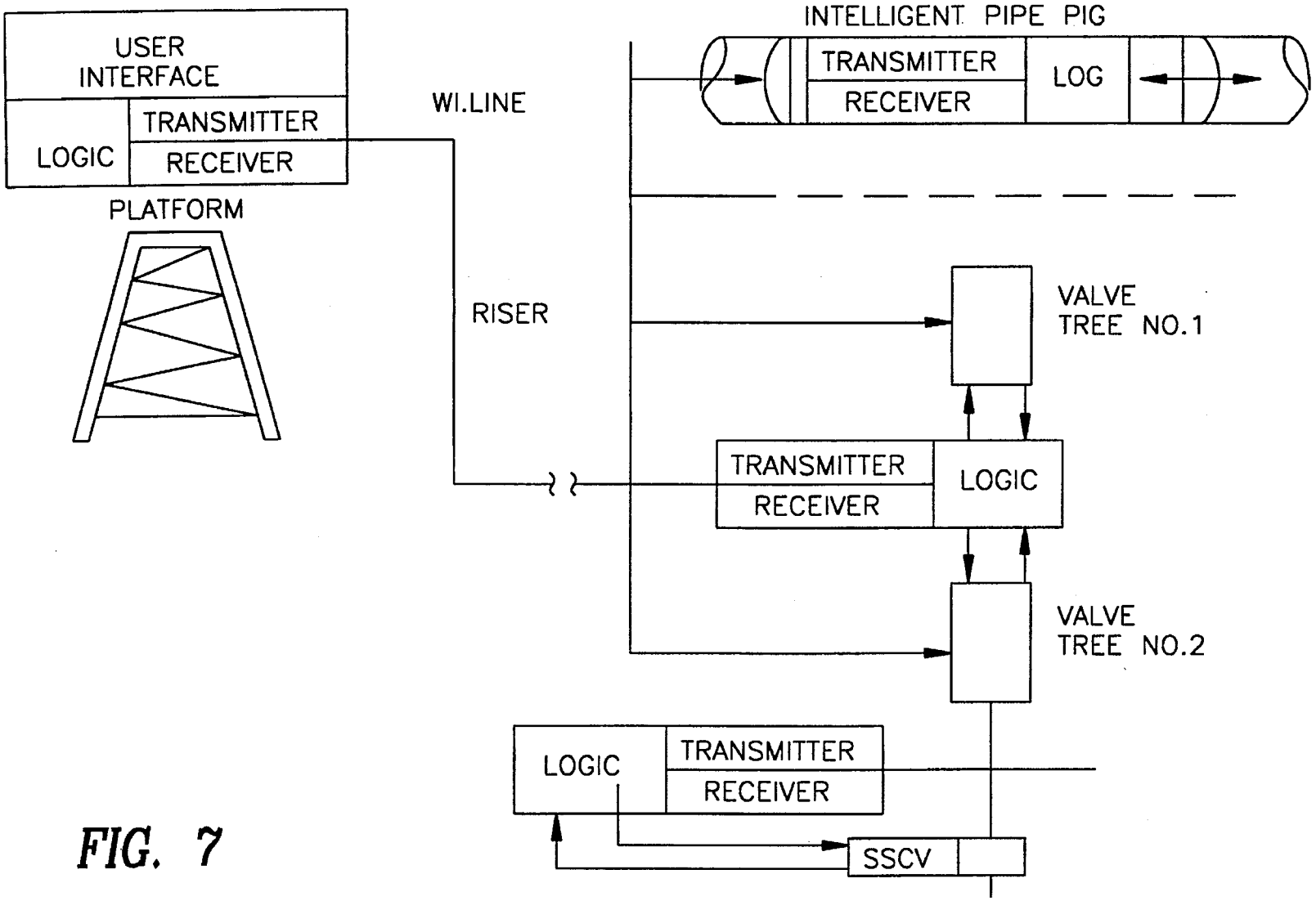
FIG. 7 shows a typical example of a Process Pipe Bus, wherein signals are communicated to and from the surface between stationary and mobile transmitters and receivers located in well branch valves, valve trees and mobile pipe pigs.

In FIG. 7 is shown the topological design of a possible Process Pipe System where frequency modulated signals are transmitted through the same pipe(s)/hose(s) as a random process medium, in this case water, being injected into a well on the seabed. The functions are as for the Signal Pipe Bus.

Figure 8:
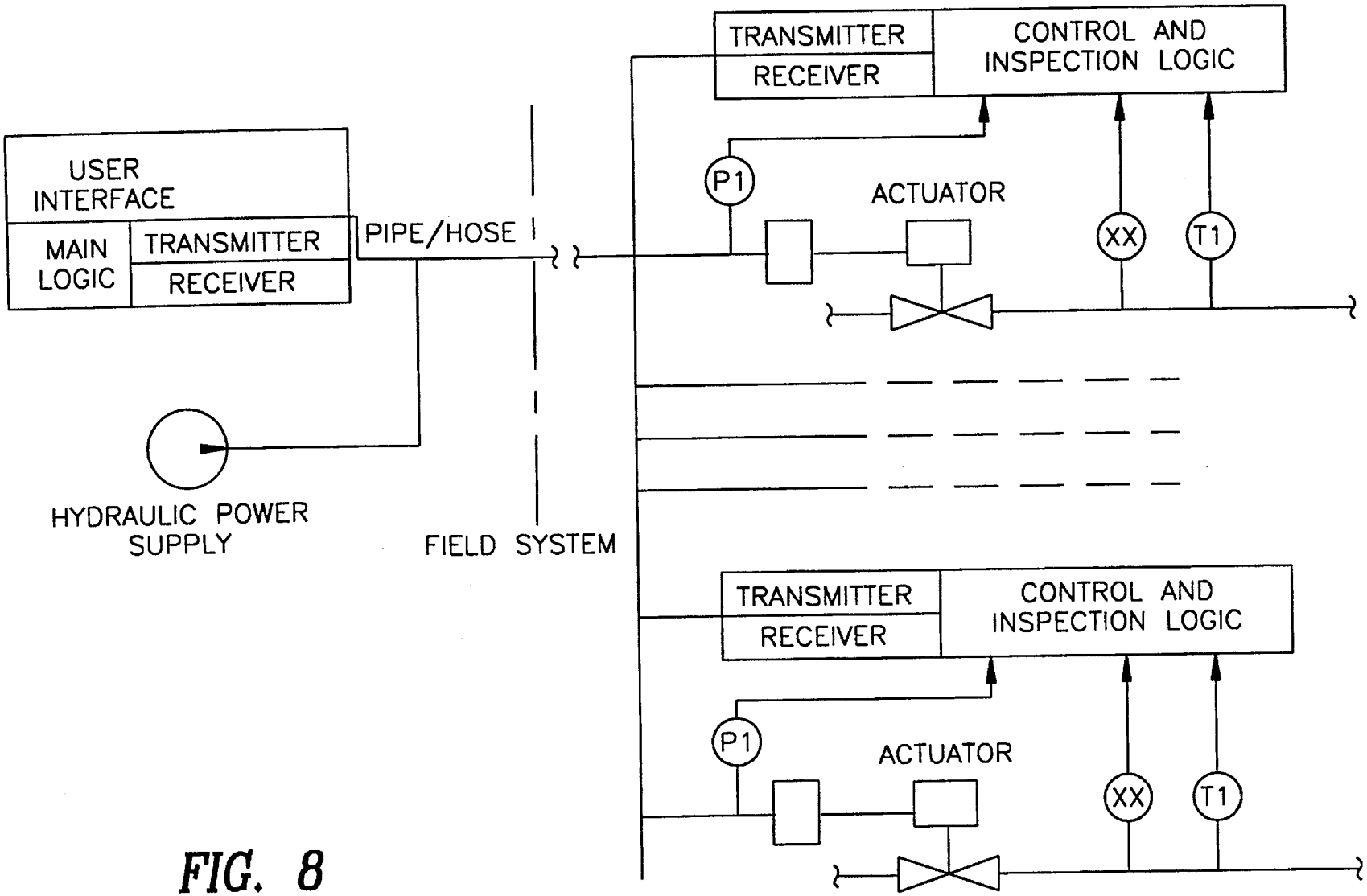
FIG. 8 shows a typical example of a Power Pipe Bus.

FIG. 8 shows the topological design of a possible Power Pipe Bus system where frequency modulated signals are transmitted in the same pipe(s)/hose(s) as a random power medium, in this case hydraulic oil. The functions are as for the Signal Pipe Bus.

Figure 9:
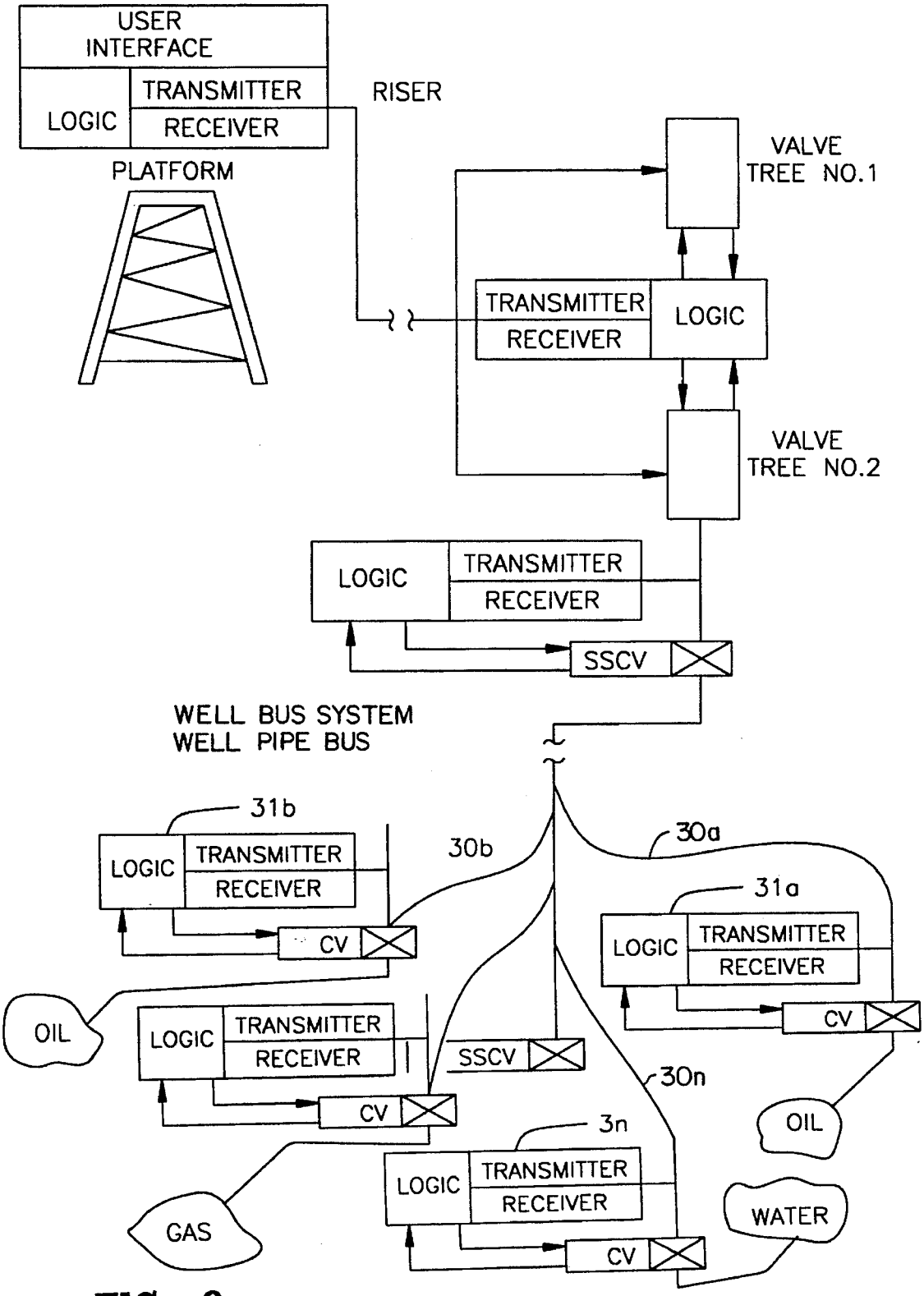
FIG. 9 illustrates the topological arrangement of a Well Bus System or Well Pipe Bus, wherein frequency modulated signals are transmitted in oil and/or gas to well branch pipes.

FIG. 9 illustrates the topological arrangement of a Well Bus System or Well Pipe Bus, wherein frequency modulated signals are transmitted in oil and/or gas to well branch pipes 30*a*, 30*b*, . . . 30*n*, through appropriate valve control means 31*a*, 31*b*, . . . 31*n*, respectively.

The invention comprises the following main items:

1. A transmitter/receiver system 11, 12 for alphanumeric communication 1, where encoded signals are transferred through liquid and gas in pipes and hoses with associated volume, with randomly placed transmitters compiling 2 and generating signals 3, and receivers recording 25 and decompiling 26 the signals into alphanumeric data, the signals being transferred through pipe/hose systems 4 which may have various main functions and contain set volumes of different sizes consisting of liquid, gas or a mixture thereof.
2. A method for increasing the accessible signal bandwidth by employing two or several frequency components in a Fourier-series in a time and frequency phase modulation 1, the sum of available codes/symbols being increased exponentially with the number of complex combinations used, and an increased communication rate being achieved, expressed in bits per second.
3. A communication system which may be described as Signal Pipe Bus where gas or liquid filled dedicated pipes and hoses with associated volume(s) are used in transferring the signals.
4. A communication system which may be described as Process Pipe Bus where randomly functioning gas or liquid filled pipes and hoses with associated volume(s) are used in transferring the signals.
5. A communication system which may be described as Power Pipe Bus where gas or liquid in pipes and hoses belonging to a power system, are used in transferring the signals.
6. A communication system which can be designed as a Well Bus System, wherein the produced gas and/or oil from the reservoir is used for transmission of signals.
7. A system for alphanumeric communication 1 where compiled data 2 are transferred to a signals generator 3 generating sequences 8 of frequency modulated changes in volume flows the corresponding pressure changes of which are being transferred through gas and liquid filled pipes/hoses 4 to randomly placed responders 5 with address 10, the frequency modulation consisting of a method where sequences 8 of a defined pressure profile put together from one or several frequency components, which in themselves or through their periodic duration, represent a defined code/symbol in a message/function 9, the responder 5 recording transmitted codes which are being decompiled 6 for definition of communicated messages/functions 7, please see in particular FIG. 1.

I claim:

1. A method for transferring signals through a medium in a system comprising pipes, hoses and drilling holes, including the steps of generating signals comprising complex frequency modulated pressure pulses at a transmitter side, wherein said pressure pulses are mainly fully defined sinusoidal pressure changes that symbolize an organized and defined bit-pattern, and decompiling the signals at a receiver side in order thereby to achieve alphanumeric communication.

2. The method of claim 1 wherein the complex frequency modlulated pressure pulses are created by combining signal frequencies into groups of two or several frequencies in simultaneous transmission.

3. The method of claim 1 wherein the pressure pulses are generated as frequency modulated pressure pulses by using two or more frequency components in a Fourier-series in a time and frequency phase modulation so that the sum of available codes/symbols is increased exponentially with the number of complex combinations used, thereby providing an increased communication rate expressed in bit/s.

4. The method of claim 1 wherein the signals generated at the transmitter side are single frequency modulated sinusoidal pressure signals which are put together into a complex signal as an element in a Fourier-series which entails substantially equal damping as if each element of the complex signal were to have been the subject of separate transmission, further wherein said damping is at optimal signal compression for ensuing decomposing for utilization of programmed information content.

5. The method of claim 1 wherein the signals are transferred through said system having various main functions and containing bound volumes of different sizes comprising liquid, gas or mixtures thereof.

6. The method of claim 5 wherein the system comprises a signal pipe bus comprising filled pipes, hoses and drilling holes with associated volume(s) used in transferring the signals.

7. The method of claim 5 wherein the system comprises a process pipe bus, where randomly functioning filled pipes, hoses and drilling holes with associated volume(s) are used in transferring the signals.

8. The method of claim 5 wherein the system comprises a pipe bus, where filled pipes in said system belonging to a power supply are used in transferring the signals.

9. The method of claim 1 further comprising providing pressure profiles or signal amplitudes, depending on the damping or amplifying properties of the system.

10. The method of claim 1 wherein the system further comprises implemented relevantly dimensioned accumulators related to the resonance and pressure reflections of the pipe system.

11. A system for transferring signals through a medium in a system comprising pipes, hoses and drilling holes comprising a transmitter including a generator for generating signals comprising pressure pulses generated as mainly fully defined sinusoidal pressure changes of various frequencies or in various frequency ranges, said transmitter (11) further comprising a compiler (2) which converts a bit pattern into frequency codes, wherein said signal generator (3) generates corresponding pressure profiles in associated pipes/hoses/drilling holes in order to provide alphanumeric communication.

12. The system of claim 11 further comprising a receiver comprising a pressure sensor, an amplifier, a filter (23) which ,allows through a predefined frequency band and pressure amplitudes and a frequency analyzer (24) which identifies time sequenced frequency elements, wherein said receiver comprises a distinct and/or a common address.

13. The system of claim 12 wherein the receiver (12) further comprises an inspection means (25) for checking the frequency analysis performed in the frequency analyzer (24), as well as a decompilator (26) which decompiles the pressure frequency modulated message into a bit pattern comprising an alphanumeric message.

14. The system of claim 13 wherein the receiver and the transmitter constitute part of a two-way system (semi duplex) where the transmitter and the receiver are combined in one unit and positioned at either end of the pipe/hose/drilling hole.

15. The system of claim 14 wherein a multitude of transmitters/receivers are placed along or inside a system comprising a pipe or a hose or a drilling hole or in a pipe system with associated volume(s), and further comprising a transmitter for directing the communication.

* * * * *